United States Patent [19]

Lamers

[11] 4,017,217

[45] Apr. 12, 1977

[54] OVERSPEED PROTECTION SYSTEM

[75] Inventor: Robert P. Lamers, Franklin Township, Pa.

[73] Assignee: Westinghouse Electric Corporation, Pittsburgh, Pa.

[22] Filed: Feb. 26, 1976

[21] Appl. No.: 661,591

[52] U.S. Cl. ..... 417/214; 60/413; 188/116; 417/223

[51] Int. Cl.[2] ..... F04B 49/00; F16D 31/02; B60T 7/12

[58] Field of Search ..... 417/214, 223; 60/413, 60/494; 188/186; 303/10, 116; 74/572

[56] References Cited

UNITED STATES PATENTS

| | | | |
|---|---|---|---|
| 3,667,816 | 6/1972 | Harned | 303/116 |
| 3,761,141 | 9/1973 | Baurle et al. | 303/116 |
| 3,871,714 | 3/1975 | Belrend | 60/413 |

*Primary Examiner*—Carlton R. Croyle
*Assistant Examiner*—G. P. LaPointe
*Attorney, Agent, or Firm*—W. A. Elchik

[57] ABSTRACT

A protection system to prevent the failure of a flywheel caused by an overspeed condition of a fluid pump. A positive displacement pump is coupled to, and driven by, the drive shaft of the fluid pump, and the positive displacement pump circulates a fluid into a discharge manifold. The fluid exits from the discharge manifold through an orifice, and returns to the positive displacement pump to be recirculated. Brake shoes are arrayed around the flywheel, and are connected to hydraulic cylinders, which in turn is connected by conduits to the discharge manifold. A pressure sensitive valve is installed in the conduit between the discharge manifold and the hydraulic cylinder. The pressure sensitive valve permits fluid to flow from the discharge manifold to the hydraulic cylinder whenever the pressure within the discharge manifold exceeds a predetermined level. The pressure in the discharge manifold, in turn, is related to the speed of the positive displacement pump, which is dependent upon the speed of the main pump drive shaft. Upon an overspeed condition, the positive displacement pump increases speed, circulates an increased quantity of fluid, which causes an increase in the manifold pressure, thereby causing the pressure sensitive valve to open and supply fluid to the hydraulic cylinders, which forces the brake shoes against the flywheel to absorb the acceleration torque of the drive shaft and prevent the failure of the flywheel by overspeed.

9 Claims, 3 Drawing Figures

OVERSPEED PROTECTION SYSTEM

BACKGROUND OF THE INVENTION

This invention relates generally to fluid pumps, and more particularly, to a protection system for preventing failure of flywheels due to a pump overspeed condition.

The use of flywheels for energy storage with pumps and motors is widespread. The flywheel typically is directly coupled to the drive shaft of the motor and the pump, and rotates therewith. The use of the flywheels, though, has problems associated therewith. For example, in the event the main pump loses coolant to be pumped, the drive shaft will increase its speed of rotation. This increased rotation speed of the drive shaft likewise increases the speed of rotation of the flywheel. Under some circumstances, the increase in speed of the drive shaft and the flywheel, or overspeed, can cause catastrophic failure of the flywheel. One such accident may be that the flywheel will literally explode off the drive shaft, thereby creating a potentially hazardous environment for operating personnel and contiguous equipment.

Numerous devices have been devised which attempt to prevent flywheel failure. Some of these devices are, for example, regenerative electrical braking and mechanical braking systems. However, these devices have disadvantages in that they are either complex, expensive, potentially unreliable, or require complex sensing devices and/or human intervention.

SUMMARY OF THE INVENTION

The aforementioned disadvantages of the prior art are eliminated by this invention by providing a flywheel overspeed protection system which is economical, simple, reliable, and does not require human intervention A positive displacement pump is coupled to, and driven by, the main pump drive shaft. The positive displacement pump circulates a fluid to a discharge manifold, and the fluid exits from an orifice in the discharge manifold to return to the positive displacement pump. The discharge manifold is in fluid communication with a hydraulic cylinder which, in turn, is coupled to a braking means. The braking means is positioned adjacent to the flywheel. Pressure responsive flow control means is connected between the hydraulic cylinder and the discharge manifold. The positive displacement pump creates a pressure in the discharge manifold which is dependent upon the speed of the pump, and correspondingly the main pump drive shaft. When the pressure in the discharge manifold exceeds a predetermined level, as would occur, for example, during an overspeed condition, the pressure sensitive flow control means allows fluid to flow from the discharge manifold to the hydraulic cylinders, which fluid causes the hydraulic cylinder to force the braking means attached thereto into contact with the flywheel. The braking means then applies a braking force to the flywheel, thereby limiting the maximum overspeed attained and preventing failure of the flywheel.

BRIEF DESCRIPTION OF THE DRAWINGS

Reference is now made to the description of the preferred embodiment, illustrated in the accompanying drawings, in which.

DESCRIPTION OF THE PREFERRED EMBODIMENT

Figure 1:
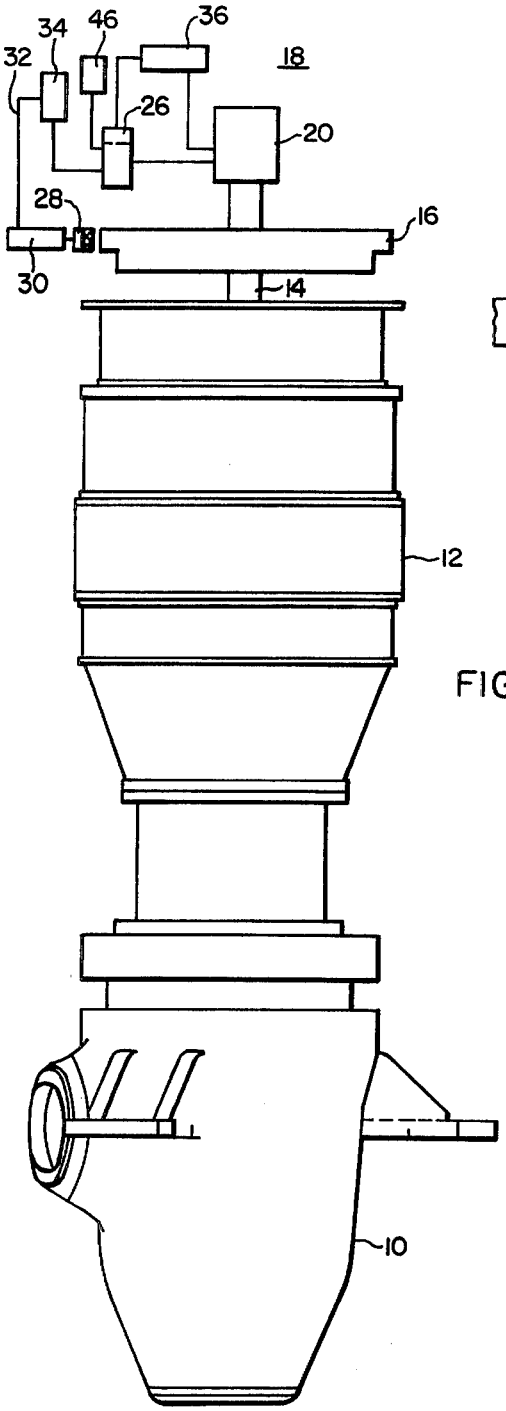
FIG. 1 is an illustration of a pump and motor set utilizing the overspeed protection device of this invention.

Throughout the description which follows, like reference characters indicate like elements in the various figures of the drawings.

Referring now to FIG. 1, a main pump 10 is coupled to a pump motor 12. The motor 12 provides the driving force for the pump 10 by means of a pump drive shaft 14. Coupled to, and driven by the drive shaft 14, is a flywheel 16. The flywheel 16 rotates with, and at the same speed as, the drive shaft 14. To prevent failure of the flywheel 16 in the event of an overspeed condition of the drive shaft 14, an overspeed protection system 18 is utilized.

The protection system 18 is comprised of a positive displacement pump 20, a discharge manifold 22, and conduit means 24 which serially interconnect the positive displacement pump 20 to the discharge manifold 22, and a return path from the discharge manifold 22 to the positive displacement pump 20. The discharge manifold 22 has an orifice 26 through which the protection system fluid, which, for example, may be oil, exits from the discharge manifold 22 into the conduit means 24 for return to the positive displacement pump 20.

Positioned adjacent to the flywheel 16 is a braking means such as brake shoes 28. The brake shoes 28 are capable of being in two positions with respect to the flywheel 16: one position is where the brake shoes 28 are in contact with the flywheel 16, thereby providing braking of said flywheel 16; and a second position in which the brake shoes 28 are in a spaced apart relationship with the flywheel 16 such that the brake shoes 28 are not in contact with the flywheel 16. The brake shoes 28 are fixedly coupled to hydraulic cylinder 30 which positions the brake shoes 28 in either of their two positions. The hydraulic cylinder 30 is in fluid communication with the discharge manifold 22 by means of conduit means 32. Inserted into the conduit means 32 is a pressure sensitive flow control means 34 such as a pressure relief valve.

Within the conduit means 24 between the discharge manifold orifice 26 and the positive displacement pump 20 is a heat exchange means 36 for removing heat from the protection system fluid.

Figure 2:
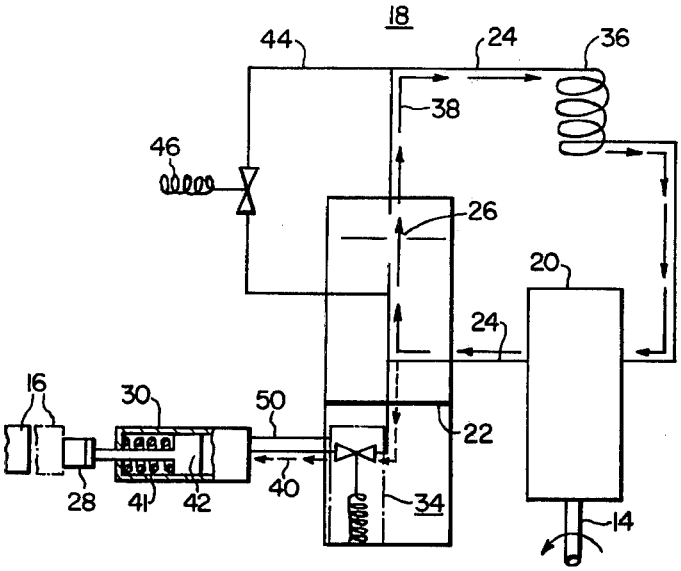
FIG. 2 is a flow schematic of the overspeed protection system.

FIG. 2 schematically illustrates the protection system 18. As shown, the solid arrows 38 delineate the flow of protection system fluid during normal operations, while the dashed arrows 40 delineate the additional flow of protection system fluid during an overspeed condition. During normal operations, the positive displacement pump 20 rotates with, and at the same speed as, the drive shaft 14. The drive shaft 14 determines the quantity of fluid the positive displacement pump 20 circulates. The fluid exits from the positive displacement pump 20, flows through conduit means 24 into the discharge manifold 22. In the discharge manifold 22, the fluid flows through an orifice 26, through conduit mans 24 to heat exchange means 36, where the pumped heat is removed from the fluid, and returns to the positive displacement pump 20. The pumping action of the positive displacement pump 20 causes a pressure to exist within the discharge manifold 22. This pressure within the discharge manifold 22 is a function both of orifice 26 size, and pump 20 speed. However, the pressure is approximately proportional to the square of the pump 20 speed. Thus, sight increases in pump 20 speed cause correspondingly larger increases in discharge manifold 22 pressure.

During an overspeed condition, the quantity of fluid being pumped by pump 20 increases, causing a rise in the pressure level within the discharge manifold 22. Pressure sensitive flow control mens 34 are arranged to be responsive to the pressure within the discharge manifold 22 such that, when the discharge manifold pressure exceeds a given level, the flow control means 34 will open and allow fluid to flow from the discharge manifold 22 through conduit means 32 to the hydraulic cylinder 30. This predetermined pressure level at which the control means 34 will open is dependent upon the desires of the designer, but should be at a level to insure safe operation of the flywheel 16. As an example, the pressure within the discharge manifold 22 which will cause the valve 34 to open can be set to be 20% above the pressure which is present within the discharge manifold 22 during normal operations.

Upon the opening of the valve 34, the fluid flows along the path designated by the arrows 40 to the hydraulic cylinder 30. The hydraulic cylinder 30 receives the fluid, and this fluid causes a displacement of a piston 42 within the hydraulic cylinder 30 against a biasing spring 41 which causes a movement of the brake shoes 28 which are fixedly coupled to the piston 42. Thus, when the valve 34 opens, the brake shoes 28 are moved against the flywheel 16 to cause a braking thereof. This braking action will continue as long as the pressure within the discharge manifold 22 remains above the predetermined level, which corresponds to the continued maintenance of an overspeed condition. Once the overspeed condition has been eliminated, the speed of the positive displacement pump 20 will decrease, causing a corresponding decrease in the pressure in the discharge manifold 22, which will close the valve 34 and stop the flow of fluid to the hydraulic cylinder 30. This will eliminate the force on the piston 42, the biasing spring 41 will reexert its force against the piston 42 and the piston 42 will return to its original position, moving the brake shoes 28 along with it and resulting in the brake shoes 28 being removed from contact with the flywheel 16.

Figure 3:
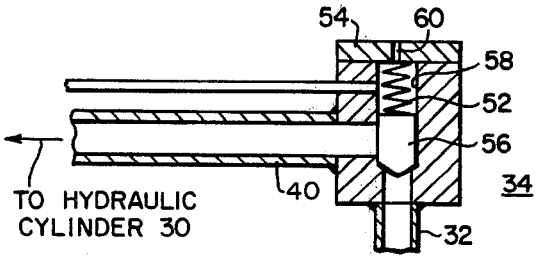
FIG. 3 is an enlargement of the flow control means utilized in the protection system.

FIG. 3 illustrates in detail the operation of the pressure relief valve 34. The valve 34 is illustrated in the closed position. A pressure spring 52 is connected at one end to the valve body 54 and at the other end to a valve piston 56. In this closed position the valve piston 56 blocks the conduit 32 such that fluid cannot flow to the hydraulic cylinder 30. A drain line 50 provides fluid communication between the hydraulic cylinder 30 and the spring chamber 58. The valve body 54 has an opening 60 therethrough which permits venting of the spring chamber 58 to the atmosphere when the valve 34 is closed, the drain line 50, the spring chamber 58 and the opening 60 cooperate to drain the hydraulic cylinder 30 of fluid therein. This draining of fluid from the hydraulic cylinder 30 is necessary to remove the force exerted against the piston 42 to move it against the biasing spring 41.

Upon an overspeed condition, the increased pressure in the discharge manifold 22 forces the valve piston 56 against the pressure spring 52 and, upon the attainment of the predetermined pressure level, the force exerted against the valve piston 56 will counteract the force of the pressure spring 52 and the valve piston 56 will be moved out of its position blocking conduit means 32. The fluid will then flow to the hydraulic cylinder 30. The movement of the valve piston 56 away from conduit means 32 places the valve piston 56 in spring chamber 58, and blocks the flow of fluid from drain line 50 into spring chamber 58. This prevents the draining of fluid from hydraulic cylinder 30 and enables the piston 42 to overcome the force of biasing spring 41 and move the braking means 28 against the flywheel 16.

A bypass conduit means 44 can be installed in parallel with the orifice 26 of the discharge manifold 22. In the bypass conduit means 44 is installed a bypass flow regulating means 46 such as a maximum pressure relief valve. The purpose of this bypass conduit means 44 and the valve 46 is to prevent the buildup of the pressure within the discharge manifold 22 above a point which may tend to cause the manifold 22 to fail. The flow regulating means 46 are responsive to the pressure within the discharge manifold 22. Upon the occurrence of a preselected pressure within the discharge manifold 22, which level is greater than that which causes the valve 34 to open, the regulating means 46 opens and permits the flow of fluid from the discharge manifold 22 to the positive displacement pump 20 without the necessity of going through the orifice 26. This bypass flow alleviates the pressure within the discharge manifold 22 and maintains the pressure within acceptable limits.

Thus, it can be seen that this system provides overspeed protection for a flywheel in a relatively simple, economical, reliable, and automatic manner.

I claim as my invention:

1. A protection system to prevent the failure of a flywheel of a fluid pump caused by an overspeed condition of said fluid pump, said flywheel being coupled to, and rotating with, a drive shaft of said fluid pump, said protection system comprising:

a positive displacement pump coupled to, and driven by, said fluid pump drive shaft, said positive displacement pump circulating a protection system fluid;

a discharge manifold serially connected to said positive displacement pump, said discharge manifold receiving said protection system fluid from said positive displacement pump, said discharge manifold having an orifice through which said protection system fluid exits from said discharge manifold, said discharge manifold having a fluid pressure therein dependent upon the speed of said positive displacement pump;

first conduit means for transporting protection system fluid from said positive displacement pump to said discharge manifold and from said discharge manifold orifice to said positive displacement pump;

braking means movably positioned adjacent to said flywheel, said braking means being capable of being in two positions with respect to said flywheel, one of said positions being in contact with said flywheel, the other of said positions being in spaced apart relationship with said flywheel, said braking means when in said position in contact with said flywheel providing braking of said flywheel;

a hydraulic cylinder fixedly coupled to said braking means and positioning said braking means in one of said two positions with respect to said flywheel, said hydraulic cylinder being in fluid communication with said discharge manifold;

second conduit means for transporting protection system fluid from said discharge manifold to said hydraulic cylinder; and pressure-responsive flow control means positioned in said second conduit means, said flow control means being responsive to said discharge manifold pressure such that, when said discharge manifold pressure is above a first predetermined pressure, said flow control means permits flow of said protection system fluid from said dishcarge manifold to said hydraulic cylinder, and when said discharge manifold pressure is below said first predetermined pressure, said flow control means prevents flow of said pressure system fluid from said discharge manifold to said hydraulic cylinder, said hydraulic cylinder positioning said braking means in response to said flow of said pressure system fluid to said hydraulic cylinder, said hydraulic cylinder positioning said braking means in contact with said flywheel when said pressure system fluid is flowing to said hydraulic cylinder, said hydraulic cylinder positioning said braking means in spaced apart relationship with said flywheel when said pressure system fluid is prevented from flowing to said hydraulic cylinder.

2. The system according to claim 1 wherein heat exchange means are positioned in said first conduit means between said discharge manifold orifice and said positive displacement pump, said heat exchange means removing heat from said protection system fluid.

3. The system according to claim 1 wherein said flow control means comprise a pressure relief valve.

4. The system according to claim 1 wherein said braking means comprise brake shoes.

5. The system according to claim 1 wherein said protection system fluid is oil.

6. The system according to claim 1 wherein bypass conduit means are in fluid communicaton with said discharge manifold and said positive displacement pump, said bypass conduit means being arranged in parallel with said discharge manifold orifice such that said protection system fluid can flow from said discharge manifold to said positive displacement pump through said bypass conduit means, bypassing said discharge manifold orifice; and bypass flow regulating means positioned in said bypass conduit means and regulating the flow of protection system fluid in said bypass conduit means, said bypass flow regulating means being responsive to said pressure in said discharge manifold.

7. The system according to claim 6 wherein said bypass flow regulating means permits the flow of said protection system fluid through said bypass conduit means whenever said discharge manifold pressure exceeds a second predetermined pressure, and prevents the flow of said protection system fluid through said bypass conduit means whenever said discharge manifold pressure is less than said second predetermined pressure.

8. The system according to claim 7 wherein said second predetermined pressure is greater than said first predetermined pressure.

9. The system according to claim 7 wherein said bypass flow regulating means comprises a maximum pressure relief valve.

* * * * *